US008561953B2

(12) United States Patent
Waggoner

(10) Patent No.: US 8,561,953 B2
(45) Date of Patent: Oct. 22, 2013

(54) UPRIGHT ADAPTER FOR SHELVING SYSTEMS

(75) Inventor: Bernard Waggoner, Lamar, MO (US)

(73) Assignee: Thorco Industries LLC, Lamar, MO (US)

( * ) Notice: Subject to any disclaimer, the term of this patent is extended or adjusted under 35 U.S.C. 154(b) by 56 days.

(21) Appl. No.: 13/034,225

(22) Filed: Feb. 24, 2011

(65) Prior Publication Data

US 2012/0217359 A1 Aug. 30, 2012

(51) Int. Cl.
*A47B 96/06* (2006.01)

(52) U.S. Cl.
USPC ..... 248/220.21; 248/235

(58) Field of Classification Search
USPC ..... 248/220.21, 235, 250, 220.22, 220.31, 248/220.41, 221.11, 225.21, 225.11, 629
See application file for complete search history.

(56) References Cited

U.S. PATENT DOCUMENTS

| | | | | |
|---|---|---|---|---|
| 3,468,430 | A * | 9/1969 | Lawman | 211/182 |
| 3,697,034 | A * | 10/1972 | Shell | 248/243 |
| 4,615,503 | A | 10/1986 | Garfinkle | |
| 5,154,388 | A | 10/1992 | Magaro | |
| 5,641,081 | A | 6/1997 | Merl | |
| 5,715,957 | A | 2/1998 | Merl | |
| 5,921,411 | A | 7/1999 | Merl | |
| 6,142,317 | A | 11/2000 | Merl | |
| 6,168,032 | B1 | 1/2001 | Merl | |
| 2004/0178156 | A1 | 9/2004 | Knorring et al. | |
| 2007/0209259 | A1 | 9/2007 | Pavlik et al. | |
| 2008/0000861 | A1 | 1/2008 | Muellerleile | |

FOREIGN PATENT DOCUMENTS

| | | |
|---|---|---|
| CA | 2621690 | 2/2009 |
| WO | WO95/26665 A1 | 10/1995 |

OTHER PUBLICATIONS

G-Force Wall Systems catalog http://www.g-force.com.au/PDF/SHOPFITTINGS-CATALOGUE-NOV09 pdf; Nov. 2009.

* cited by examiner

*Primary Examiner* — Anita M King
(74) *Attorney, Agent, or Firm* — R. Blake Johnston, Esq.; DLA Piper LLP US

(57) ABSTRACT

An upright adapter for attaching an otherwise non-compatible fixture, such as a shelf assembly, to a shelving system upright featuring a number of slots separated by a number of dividers features an adapter tube. The adapter tube also features a number of slots separated by a number of dividers. A number of locking tabs are attached to the adapter tube. The locking tabs are adapted to engage the slots and dividers of the shelving system upright. A sliding tab featuring a leading end is attached to the adapter tube in a sliding fashion so as to move between a retracted position and an extended position. When in the extended position, the leading end of the sliding tab engages a slot of the shelving system upright so as to lock the upright adapter to the upright.

17 Claims, 6 Drawing Sheets

UPRIGHT ADAPTER FOR SHELVING SYSTEMS

FIELD OF THE INVENTION

The present invention relates to merchandise shelving systems and, more particularly, to an upright adapter for use with such shelving systems.

BACKGROUND

Shelving systems typically include gondolas or shelf mounts for walls and the like and are used in retail and warehouse facilities to display and stock merchandise. The gondolas or shelf mounts of such shelving systems typically feature slotted uprights that receive the locking tabs of shelf assemblies or other fixtures. The slots of the uprights are sized and spaced in such a way that only shelf assemblies or other fixtures having locking tabs designed specifically for the uprights may be used in the shelving system. As a result, if alternative shelf assemblies or fixtures are to be used, the gondola or shelf mount uprights must be replaced with compatible uprights. This is inefficient, costly and time-consuming.

A need exists for an upright adapter that permits the uprights of a gondola or shelf mount to support shelf assemblies or other fixtures, having locking tabs that would otherwise not be compatible with the slots of the shelving system uprights. It would be desirable for such an adapter to attach to the upright in a locking fashion without tools for ease of installation and removal.

DETAILED DESCRIPTION OF EMBODIMENTS

Figure 1:
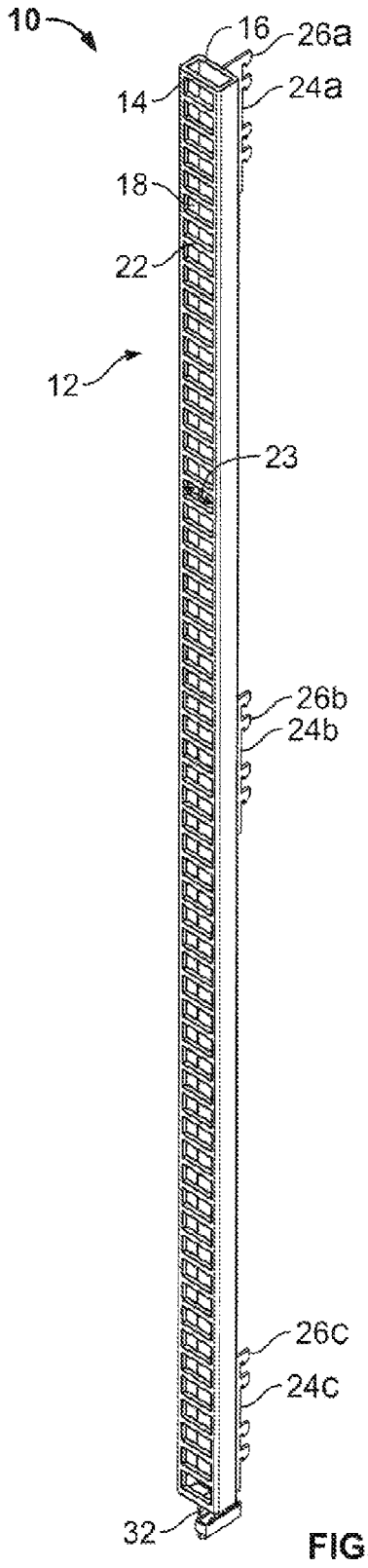
FIG. 1 is a perspective view of an embodiment of the upright adapter of the present invention.
Figure 2:
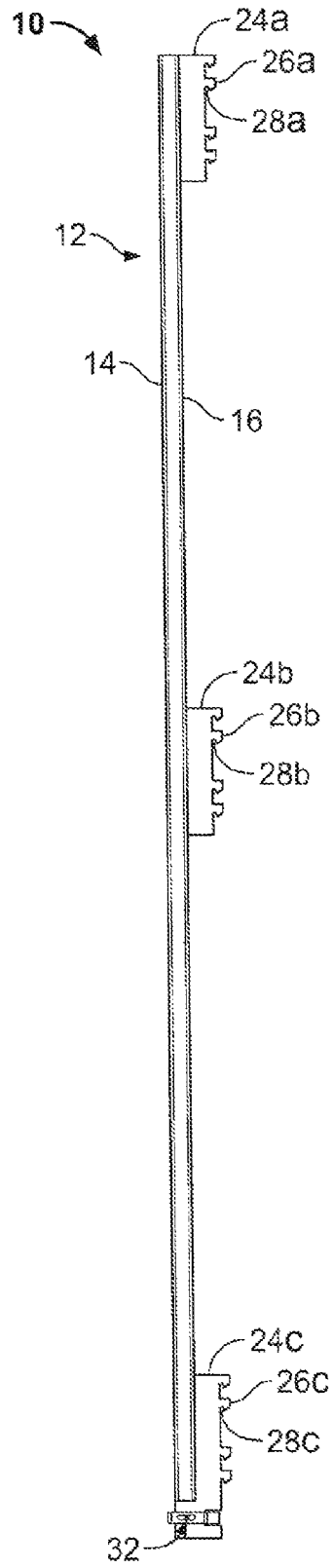
FIG. 2 is a side elevational view of the upright adapter of FIG. 1.

An embodiment of the upright adapter of the present invention is indicated in general at 10 in FIGS. 1 and 2. The upright adapter features an adapter tube, indicated in general at 12, having a generally rectangular cross-section so that a front side 14 and a back side 16 are defined. The front side of the adapter tube is provided with slots 18 that are separated by dividers 22. It should be noted that while a generally rectangular cross-section is illustrated for adapter tube 12, other cross-sectional shapes may be used, including, but not limited to, square and U-shaped. In addition, the slots and dividers may alternatively be positioned on either the right or left sides of the adapter tube, instead of the front side. Furthermore, the slots and dividers of the adapter tube may be shaped other than as shown.

Each of the slots 18 of the adapter tube preferably features a width, indicated at 23 in FIG. 1, that is sized so that two or more locking tabs of shelf assemblies and/or other fixtures (described below with respect to FIGS. 5-7) may be received therein side-by-side. As a result, a pair of shelf assemblies and/or other fixtures may be installed side-by-side using only three of the adapter tubes installed on the uprights of a shelving system or gondola.

As illustrated in FIGS. 1, 2, 3A and 3B, mounting members 24*a*, 24*b* and 24*c* are secured to the back side 16 of the adapter tube. Mounting member 24*a* is provided with locking tabs 26*a*, each of which are provided with a notch 28*a*. Mounting member 24*b* similarly features locking tabs 26*b* having notches 28*b*, while mounting member 24*c* similarly features locking tabs 26*c* having notches 28*c*. While three mounting members are illustrated, an alternative number of locking members, or even one large, single mounting member, may be used instead. Furthermore, while four locking tabs are illustrated for each mounting member, alternative numbers of tabs may be used.

Adapter tube 12 is preferably formed from metal. Each mounting member, including its locking tabs, is preferably integrally formed from a steel plate. The mounting members are preferably attached to the adapter tube by welding, however, alternative fastening arrangements may be used. Such fastening arrangements include, but are not limited to, adhesive or fasteners such as rivets, screws or the like.

As illustrated in FIGS. 1, 2, 3A and 3B, the bottom mounting member 24*c* is also provided with a sliding tab mechanism 32. It should be noted that the sliding tab mechanism may alternatively be positioned at another location on the upright adapter and may be attached to the upright adapter independently of a mounting member.

Figure 3B:
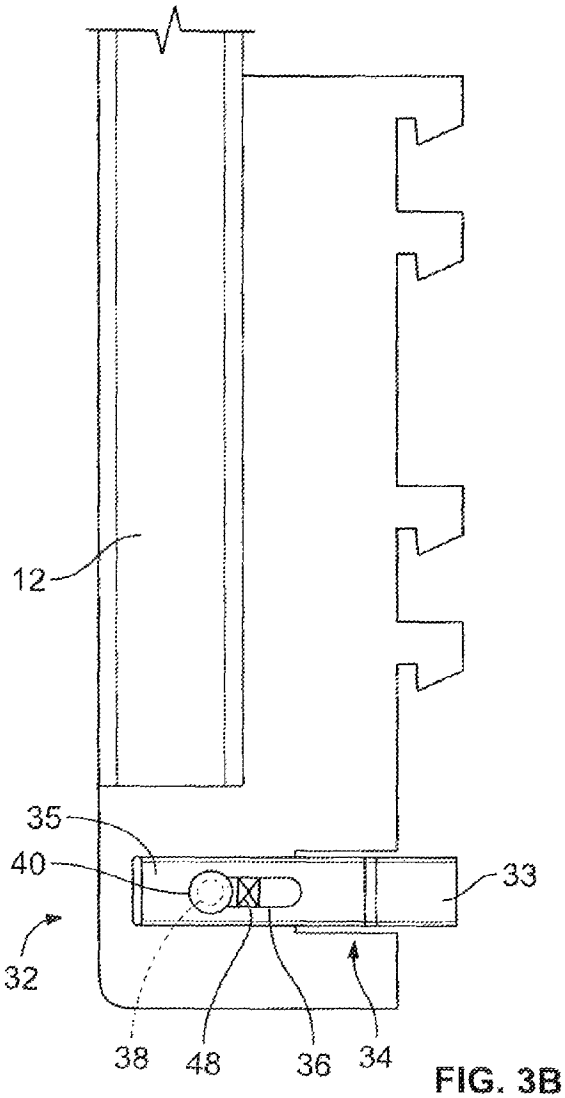
FIGS. 3A and 3B are enlarged, side elevational views of the lower portion and sliding tab of the upright adapter of FIGS. 1 and 2 illustrating the sliding tab in the retracted and extended configurations, respectively.
Figure 3A:
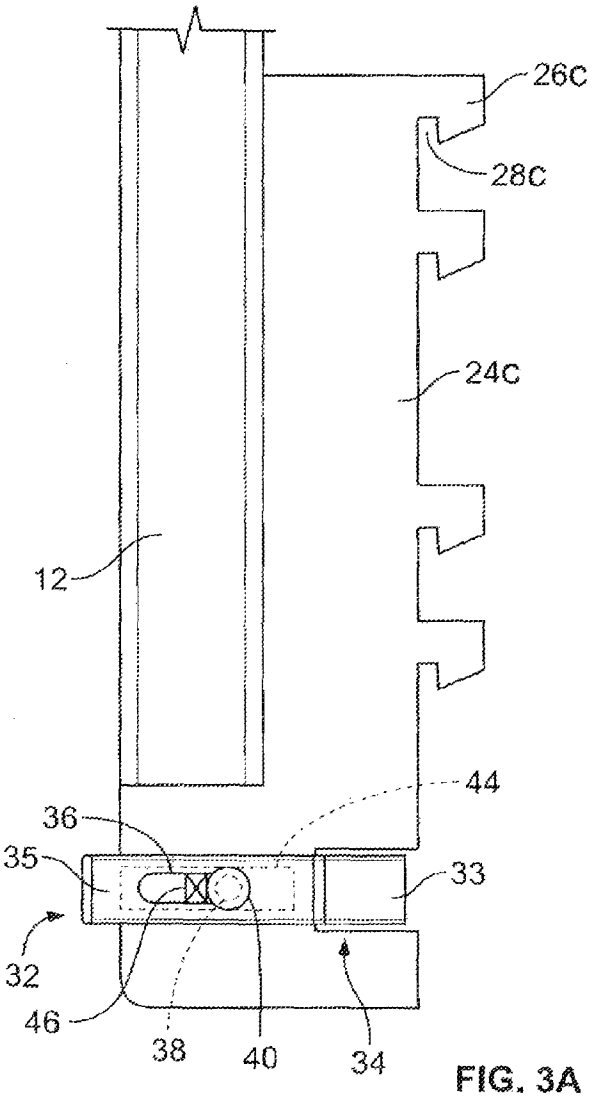

As illustrated in FIGS. 3A and 3B, the sliding tab mechanism 32 features a sliding tab, indicated in general at 34, that features an elongated slot 36. In addition, the sliding tab features a leading end 33 and a trailing end 35. A pin 38 having an enlarged head portion 40 is secured to the mounting member 24*c*. The elongated slot 36 of the sliding tab is sized so that the pin 38 passes through and slides therein as the sliding tab is moved horizontally. The head portion 40 of the pin, however, is too large to pass through the elongated slot 36. As a result, the sliding tab 34 may be slid between the retracted position illustrated in FIG. 3A and the extended position illustrated in FIG. 3B as the pin 38 traverses the elongated slot 36 of the sliding tab 34.

The sliding tab is preferably thick enough to allow a user to grasp it with the user's finger tips to move it between the extended and retracted positions. A user would typically push on the trailing end 35 of the sliding tab 34 to move it into the extended position. The sliding tab 34 features a channel formed on its back side and illustrated in phantom at 44 in FIG. 3A. A pair of raised guides, illustrated at 46 in FIG. 3A and 48 in FIG. 3B, are formed on or attached to the mounting member 24*c* and are received within the channel 44. Channel 44 and guides 46 and 48 are sized and positioned so that the sliding tab 34 is maintained in a generally horizontal orientation as it slides between the retracted and extended positions illustrated in FIGS. 3A and 3B.

Figure 4:
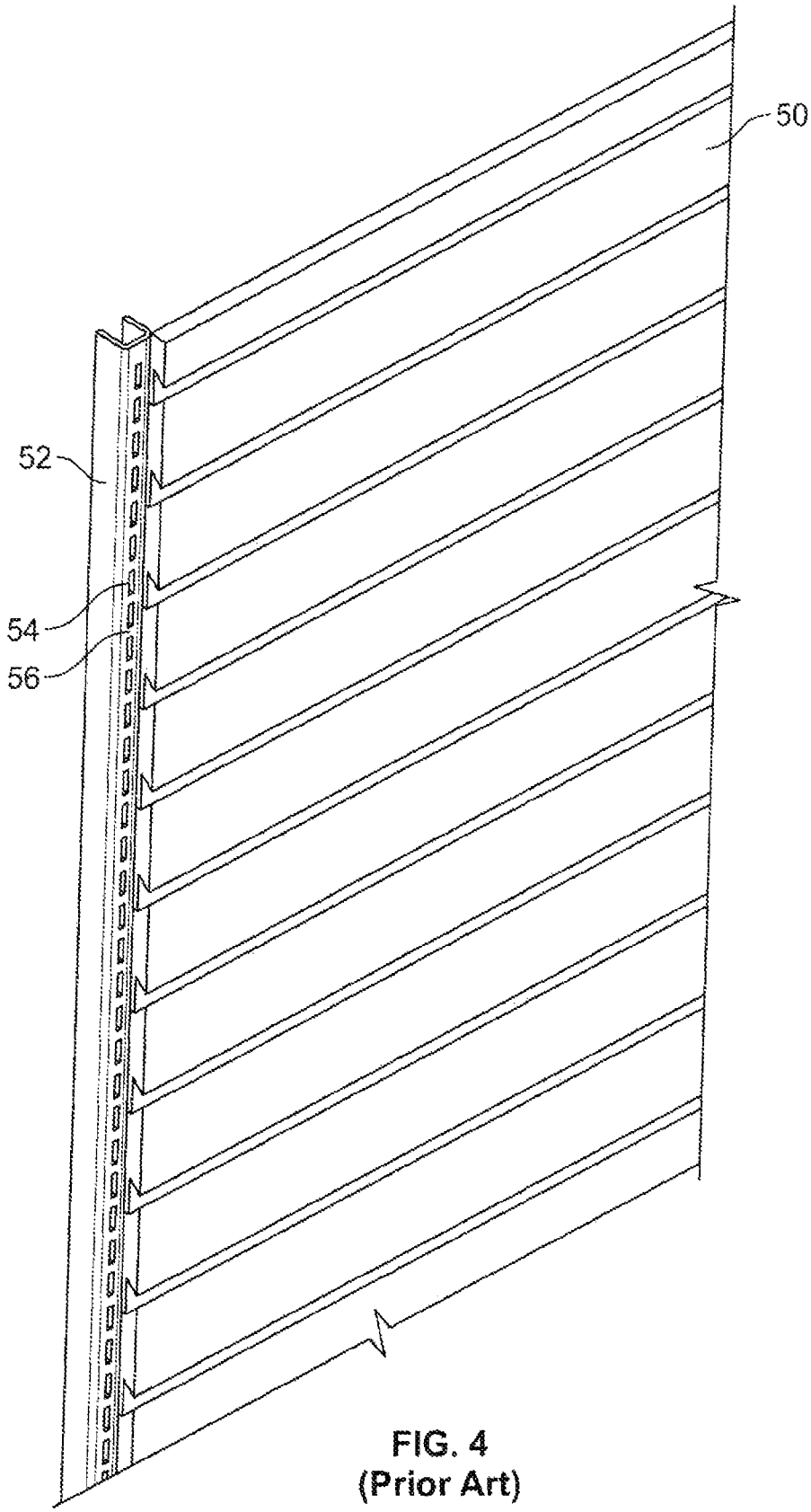
FIG. 4 (Prior Art)
FIG. 4 is a partial perspective view of a prior art gondola upright and slat wall.

A prior art slat wall and gondola upright are illustrated at 50 and 52, respectively, in FIG. 4. While a gondola upright is illustrated and used to describe the invention as an example below, it should be understood that uprights of shelf mounts or other shelving systems may be used with the upright adapter instead. The gondola upright 52 features a number of slots 54 separated by dividers 56. The gondola uprights are typically used as a pair, with one positioned on each side of the slat wall 50, as illustrated at 52 and 62 in FIG. 5.

Figure 5:
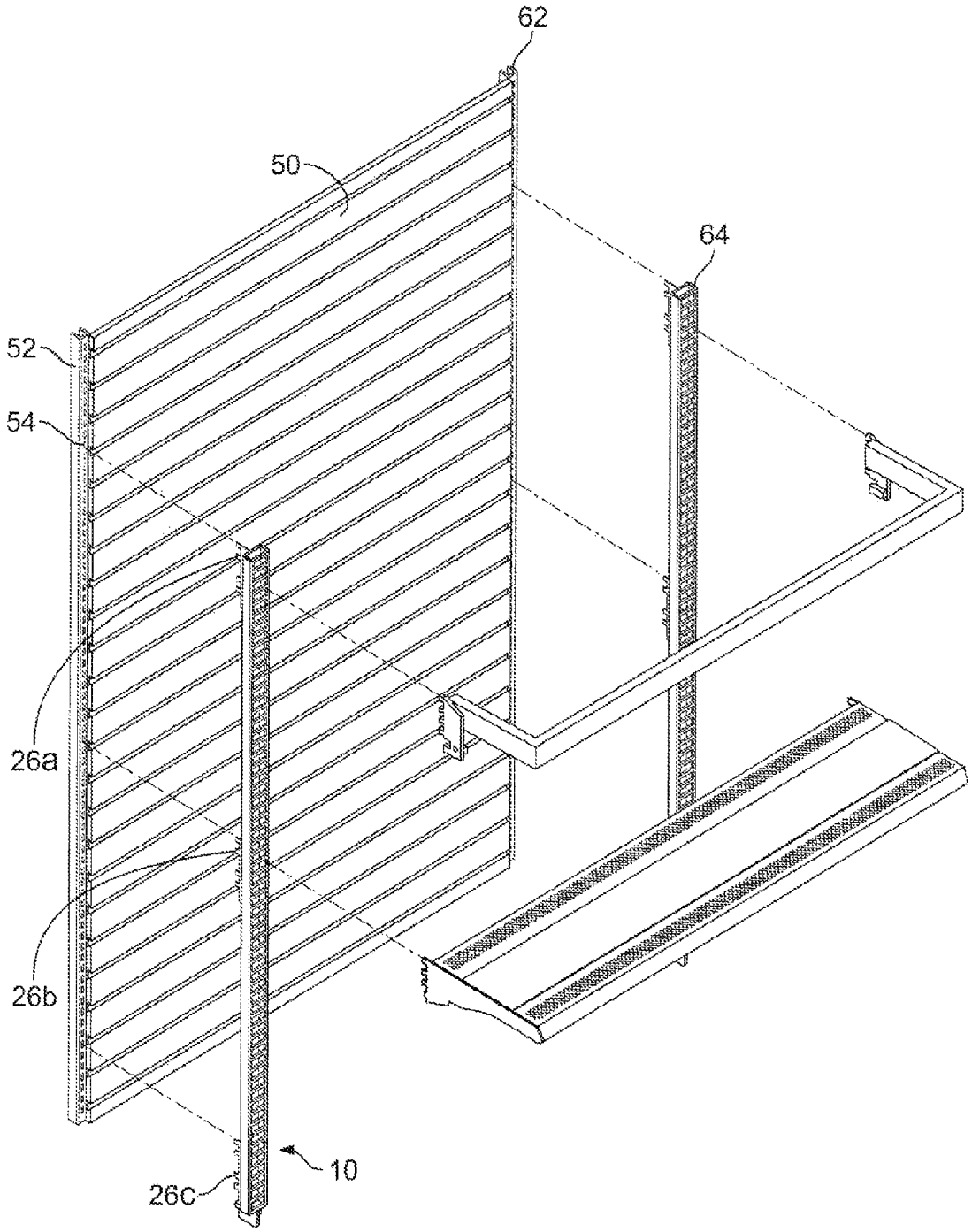
FIG. 5 is an exploded perspective view of a pair of upright adapters, each of the construction illustrated in FIGS. 1 and 2, the complete gondola uprights and slat wall of FIG. 4 and a shelf assembly and a fixture.
Figure 6:
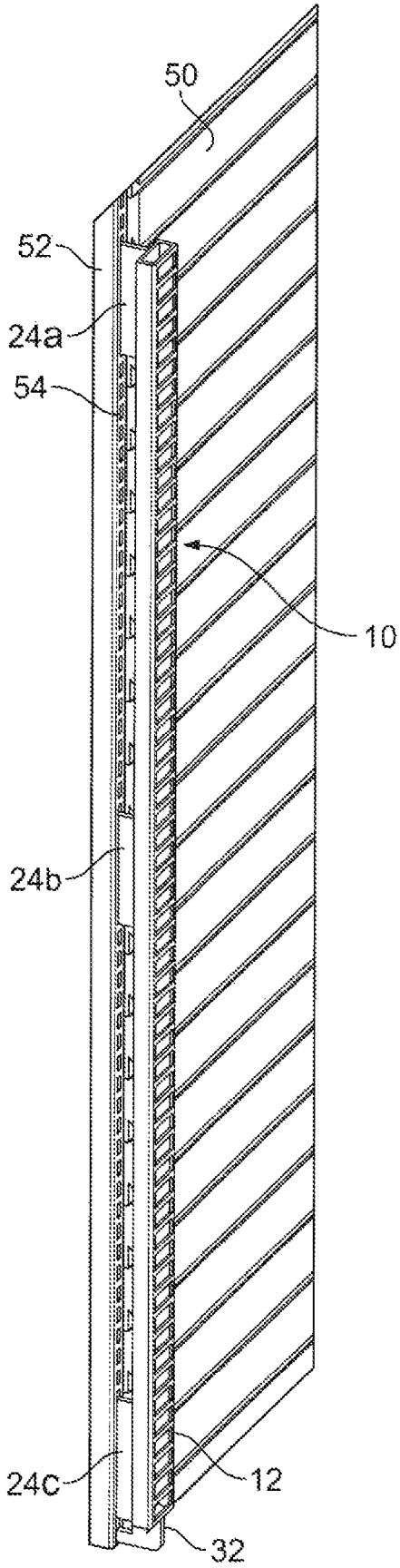
FIG. 6 is an enlarged, partial perspective view illustrating one of the upright adapters of FIGS. 1, 2 and 5 installed on one of the gondola uprights of FIGS. 4 and 5.

As illustrated in FIG. 6, upright adapter 10 is attached to gondola upright 52 by engaging the slots 54 of the upright with the locking tabs 26*a*, 26*b* and 26*c* of the upright adapter mounting members 24*a*, 24*b* and 24*c*. More specifically, the locking tabs 26*a*, 26*b* and 26*c* of the upright adapter, which are sized and spaced to as to be compatible with the slots and dividers of gondola upright 52, are inserted into corresponding slots 54 of the gondola upright. Next, the upright adapter is lowered so that the notches 28*a*, 28*b* and 28*c* of the locking tabs engage the dividers 56 (FIG. 5) that are adjacent to the bottom of each corresponding slot 54.

Once the upright adapter is attached to the gondola upright, as illustrated in FIG. 6, the sliding tab mechanism 32 is used to lock it in place. More specifically, the sliding tab 34 is in the retracted position illustrated in FIG. 3A when the upright adapter is installed on the gondola upright, as described above. The sliding tab is then slid into the extended position illustrated in FIG. 3B so that the leading end 33 of the sliding tab enters the corresponding gondola upright slot 54 (FIG. 6). As a result, the upright adapter cannot be moved upwards so as to release the locking tabs, and the upright adapter is locked in the installed condition illustrated in FIG. 6.

Upright adapter 64 of FIG. 5 features a construction similar to upright adapter 10, and thus is attached to gondola upright 62 using the same procedure.

Figure 7:
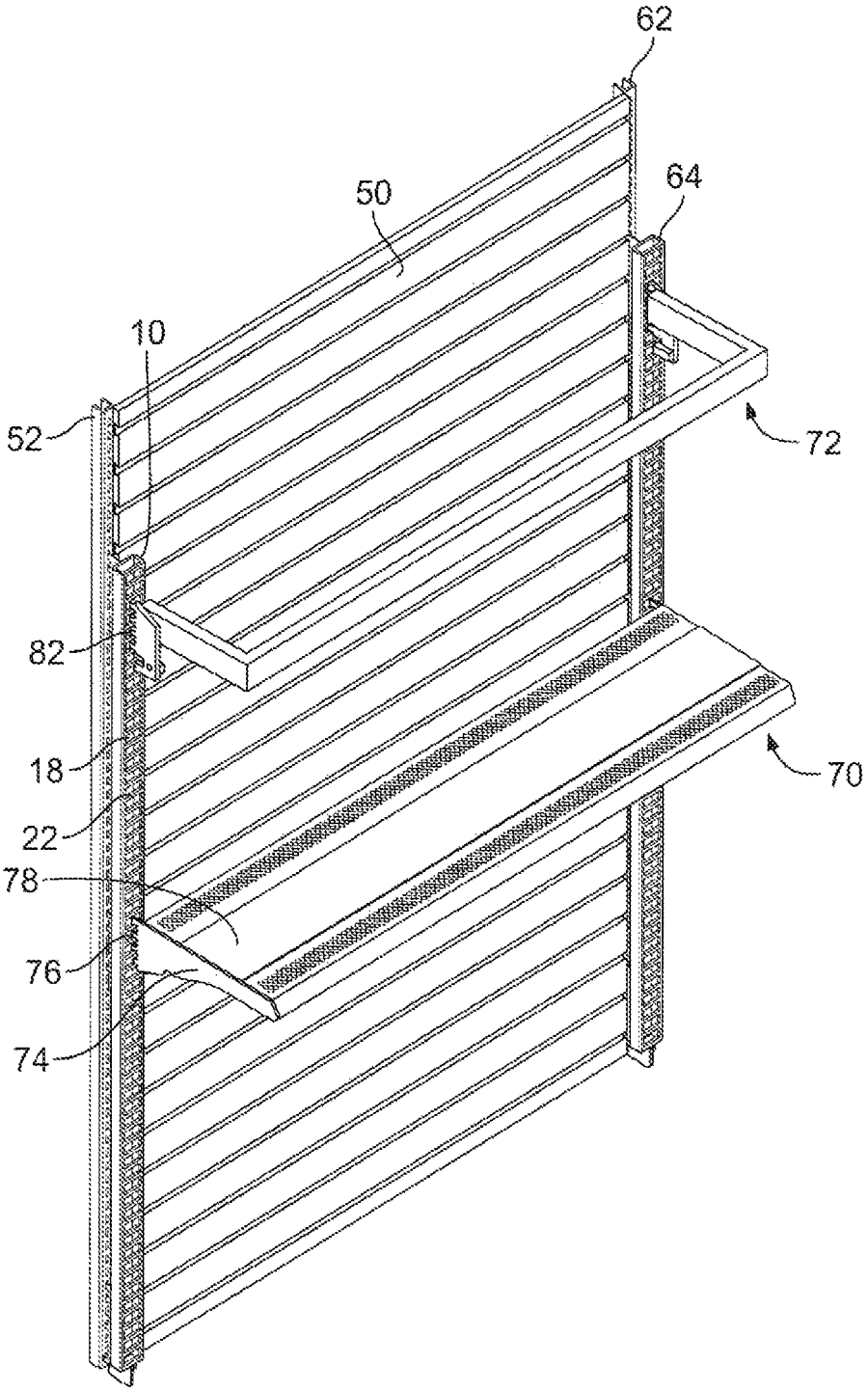
FIG. 7 is a perspective view of the upright adapters of FIG. 5 installed on the gondola uprights of FIG. 5 and the shelf assembly and the fixture of FIG. 5 installed on the upright adapters.

Once the upright adapters 10 and 64 are attached to the gondola uprights 52 and 62, respectively, as illustrated in FIG. 7, a shelf assembly 70 or other fixture, such as rack 72, having locking tabs compatible with the size and spacing of the slots of the upright adapters 10 and 62 may be installed on the shelving system. More specifically, as illustrated in FIG. 7, the shelf assembly 70 features a first shelf bracket 74 that features locking tabs 76, each of which includes a notch as with the locking tabs 26*a*, 26*b* and 26*c* described above, which are sized and spaced to engage the slots 18 and dividers 22 of the upright adapter 10. The shelf assembly 70 also features a second shelf bracket (not shown) that features locking tabs that engage the slots and dividers of upright adapter 64 in a similar fashion. A shelf pan 78 is supported by the shelf brackets on the upright adapters 10 and 64, and thus on the gondola uprights 52 and 62. As is known in the art, the shelf pan may be attached to the brackets by a number of fastening arrangements including, but not limited to, welding, adhesive or fasteners such as screws or rivets.

Rack 72 features locking tabs 82 at a first end that are sized and spaced to engage the slots 18 and dividers 22 of the upright adapter 10. The rack 72 also features locking tabs on a second end that engage the slots of upright adapter 64.

The gondola uprights 54 and 62 may be returned to their original configuration by simply reversing the above steps. That is, the locking tabs of the shelf assembly and the rack are removed from the upright adapters 10 and 64. The sliding tabs of the sliding tab mechanisms of the upright adapters 10 and 64 may then be moved into the retracted position, illustrated for sliding tab 34 of upright adapter 10 in FIG. 3A. Each upright adapter may then be lifted slightly so that the upright adapter locking tabs disengage the corresponding dividers of the gondola uprights. The upright adapters may then be pulled out of the corresponding slots and away from the corresponding gondola upright to complete the disassembly.

In view of the above, the upright adapter may be easily installed and uninstalled quickly and easily without the use of tools. When installed, the sliding tab locks the upright adapter to the shelving system upright in a secure fashion. The upright adapter expands the usefulness of existing gondola or shelf mount uprights.

While the preferred embodiments of the invention have been shown and described, it will be apparent to those skilled in the art that changes and modifications may be made therein without departing from the spirit of the invention, the scope of which is defined by the appended claims.

What is claimed is:

1. An upright adapter for attaching a fixture to a shelving system upright featuring at least a first slot and a second slot comprising:

a) an adapter tube featuring a plurality of slots separated by a plurality of dividers;

b) a locking tab adapted to engage the first slot of the shelving system upright;

c) a sliding tab featuring a leading end, said sliding tab attached to the adapter tube in a sliding fashion so as to move between a retracted position and an extended position, where the leading end of the sliding tab is adapted to engage the second slot of the shelving system upright when in the extended position so as to lock the upright adapter to the upright; and d) a mounting member upon which the locking tab is positioned and wherein the locking tab is attached to the upright adapter by the mounting member.

2. The upright adapter of claim 1 wherein the adapter tube features a first side and a second side and wherein the plurality of slots and plurality of dividers are positioned on the first side and the locking tab is positioned on the second side.

3. The upright adapter of claim 2 wherein the first side is a front side of the adapter tube and the second side is a back side of the adapter tube.

4. The upright adapter of claim 2 wherein the adapter tube features a rectangular cross section.

5. The upright adapter of claim 1 wherein a plurality of locking tabs are positioned on the mounting member.

6. The upright adapter of claim 5 wherein each of the locking tabs includes a notch.

7. The upright adapter of claim 5 wherein a plurality of mounting members, each with a plurality of locking tabs positioned thereon, are attached to the adapter tube.

8. The upright adapter of claim 1 wherein the sliding tab is mounted on the mounting member and thereby attached to the adapter tube.

9. The upright adapter of claim 1 wherein the locking tab includes a notch.

10. The upright adapter of claim 1 wherein the sliding tab is positioned on a bottom portion of the adapter tube.

11. The upright adapter of claim 1 wherein the sliding tab moves in a generally horizontal direction between the retracted position and the extended position.

12. An upright adapter for attaching a fixture to a shelving system upright featuring at least a first slot and a second slot comprising:

a) an adapter tube featuring a plurality of slots separated by a plurality of dividers;

b) a locking tab attached to the adapter tube, said locking tab adapted to engage the first slot of the shelving system upright;

c) a sliding tab featuring a leading end, said sliding tab attached to the adapter tube in a sliding fashion so as to move between a retracted position and an extended position, where the leading end of the sliding tab is adapted to engage the second slot of the shelving system upright when in the extended position so as to lock the upright adapter to the upright; and d) a pin attached to the adapter tube and wherein the sliding tab features an elongated slot that receives the pin in a sliding fashion.

13. The upright adapter of claim 12 wherein the pin features an enlarged head portion that prevents the pin from being removed from the elongated slot of the sliding tab.

14. The upright adapter of claim 12 further comprising a raised guide positioned on the adapter tube wherein the sliding tab features a channel that receives the raised guide in a sliding fashion.

15. An adapter system for a shelving system upright featuring a first slot and a second slot comprising:

a) an upright adapter including:

i. an adapter tube featuring a plurality of slots separated by a plurality of dividers;

ii. a locking tab attached to the adapter tube, said locking tab adapted to engage the first slot of the shelving system upright;

iii. a sliding tab featuring a leading end, said sliding tab attached to the adapter tube in a sliding fashion so as to move between a retracted position and an extended position, where the leading end of the sliding tab is adapted to engage the second slot of the shelving system upright when in the extended position so as to lock the upright adapter to the upright;

b) a shelf assembly including first and second shelf brackets upon which a plurality of fixture locking tabs are positioned and a shelf pan adapted to be positioned upon and supported by the first and second shelf brackets, where the plurality of fixture locking tabs are adapted to engage the plurality of slots of the adapter tube.

16. The adapter system of claim 15 wherein the adapter tube features a front side and a back side and wherein the plurality of slots and plurality of dividers are positioned on the front side and the locking tab is positioned on the back side.

17. An adapter system for a shelving system upright featuring a first slot and a second slot comprising:

a) an upright adapter including:

i. an adapter tube featuring a plurality of slots separated by a plurality of dividers;

ii. a locking tab attached to the adapter tube, said locking tab adapted to engage the first slot of the shelving system upright;

iii. a sliding tab featuring a leading end, said sliding tab attached to the adapter tube in a sliding fashion so as to move between a retracted position and an extended position, where the leading end of the sliding tab is adapted to engage the second slot of the shelving system upright when in the extended position so as to lock the upright adapter to the upright;

b) a fixture featuring a plurality of fixture locking tabs adapted to engage the plurality of slots of the adapter tube;

c) wherein the adapter tube locking tab and the fixture locking tabs each include a notch.

* * * * *